US006748673B2

(12) United States Patent
Coplon et al.

(10) Patent No.: US 6,748,673 B2
(45) **Date of Patent: *Jun. 15, 2004**

(54) METHOD, SYSTEM AND SHOE ENABLING THE DETERMINATION OF FIT FROM OUTSIDE OF THE SHOE

(76) Inventors: H. Kevin Coplon, Jl. Rancabentang Lama no. 7, Bandung (ID); Will St. Onge, Jl. Setrasari Atas no. 1, Bandung (ID)

( * ) Notice: Subject to any disclaimer, the term of this patent is extended or adjusted under 35 U.S.C. 154(b) by 52 days.

This patent is subject to a terminal disclaimer.

(21) Appl. No.: 10/158,442

(22) Filed: May 30, 2002

(65) Prior Publication Data

US 2002/0144427 A1 Oct. 10, 2002

Related U.S. Application Data

(63) Continuation-in-part of application No. 09/644,919, filed on Aug. 23, 2000, now Pat. No. 6,415,530.

(51) Int. Cl.[7] ..... A42D 1/00

(52) U.S. Cl. ..... 36/8.4; 36/112; 33/3 R

(58) Field of Search ..... 36/8.4, 112, 3 R–25 R; 33/3 R

(56) References Cited

U.S. PATENT DOCUMENTS

| | | | | | |
|---|---|---|---|---|---|
| 2,029,553 | A | * | 2/1936 | Bartschi et al. | 36/1 |
| 2,109,780 | A | * | 3/1938 | Mott | 36/1 |
| 2,126,608 | A | * | 8/1938 | Brady | 36/1 |
| 2,255,099 | A | * | 9/1941 | Brady | 36/1 |
| 2,464,571 | A | * | 3/1949 | Gardner | 36/1 |
| 4,931,773 | A | * | 6/1990 | Rosen | |
| 5,084,988 | A | * | 2/1992 | Berger | 36/112 |
| 6,415,530 | B1 | * | 7/2002 | Coplon et al. | 36/8.4 |

* cited by examiner

*Primary Examiner*—M. D. Patterson
(74) *Attorney, Agent, or Firm*—Dennis G. LaPointe; Mason Law, P.L.

(57) ABSTRACT

The invention relates to a method, system and shoe for determining the fit of a shoe from outside the shoe wherein the shoe has an outsole with reference marks such that when the bottom of a person's foot is placed against the outsole, the reference marks can be used to determine the proper fit of the shoe.

81 Claims, 5 Drawing Sheets

METHOD, SYSTEM AND SHOE ENABLING THE DETERMINATION OF FIT FROM OUTSIDE OF THE SHOE

RELATED APPLICATION

This application is a continuation-in-part of U.S. patent application Ser. No. 09/644,919 filed Aug. 23, 2000 now U.S. Pat. No. 6,415,530.

BACKGROUND OF THE INVENTION

1. Field of the Invention

The invention relates to a method, system and shoe for determining fit of a shoe from outside the shoe.

2. Description of Related Art

Many types of shoes are known in the art. Some shoes known in the art provide means for determining if they fit. However, none of the prior art provides a way to determine whether a shoe will fit from outside the shoe without trying it on. Conventional fitting methods include the use of separate measuring devices such as a Brannock Device. From this, a numerical size reading for length and possibly width is obtained and matching size shoe tried on in the brand and style selected. The problem is manufacturers use different standards for fit measurements. One brand's size six may fit as another brand's size five. Shoe shape varying based on styles may cause shoes to fit differently in relation to size marking. International size conversions can further complicate choosing the correct size. Also, a person may be in a hurry and not want to take time to try on a shoe. Also, room to try on a shoe may not be available where the shoe is sold. A shoe may be sold where there is insufficient experienced staff to help a person choose the correct size. In addition, a person buying a shoe for a child may not be able to determine the room within the shoe for growth of a child's foot.

For example, U.S. Pat. No. 5,014,041 to Rosen and U.S. Pat. No. 5,084,988 to Berger disclose shoes with transparent soles through to the interior of the shoe to provide some indicate of general fit of the foot inside a shoe and when a foot is outgrowing a shoe. These disclosures require that a person wear the shoe before being able to determine whether they fit. Also, trying to determine fit while the person that wears the shoe has on socks would be difficult, not knowing if the socks are too loose or too tight giving an inaccurate view of the actual foot length. Additionally, Rosen and Berger suffer from the fact that over time the transparent soles may discolor and get scuffs so that a person could not look through them.

The use of removable insoles or socks with printed length areas, which are removable from the inside of the shoe, are known in the industry. In addition, U.S. Pat. No. 2,464,571 to Gardner discloses a removable shoe-fit indicator which indicates the fit of the shoe on the child on an insole. To use the indicator in Gardner, a person must put coloring on the removable indicator which will color a child's toes or socks to indicate the fit of the shoe. The interior pieces would make the process of making the shoe more expensive, and would impact the comfort of the shoe. The use of coloring makes Gardner messy and inconvenient.

Patterns on the outsole of a shoe are also known. U.S. Pat. No. 4,266,349 to Schmohl discloses a profile pattern on a sole that has a plurality of concentric circles. The profile pattern in Schmohl is irrelevant to the issue of fit; it is used for the absorption and transfer of the forces acting upon the sole.

None of the devices in the above references solve the problem of determining whether a shoe will fit a person's foot without the person trying on the shoe. Furthermore, none of the devices solve the problem of determining the room for growth that a shoe may have without trying on the shoe. Each of the prior art references above require a person to try on a shoe at least once.

SUMMARY OF THE INVENTION

The principal object of the invention is to provide a shoe wherein a person can determine whether a shoe fits without trying it on.

The present invention is a system and related method of use of said system, including a shoe or a shoe with an outsole having a fitting reference gauge affixed to the outsole that defines an internal space within the shoe relative to fit, such that it is visible when looking at the bottom surface of the outsole.

In a preferred embodiment, a heel reference mark is placed at the proximal end of the outsole for placing the heel of a foot; and a first reference mark at the distal end of the outsole corresponding to where the end of the longest toe of the foot should extend when the heel is placed on the heel location mark to ensure a proper fit of the shoe on the foot. In an alternative embodiment, the heel reference mark corresponds to the location of a person's heel inside the shoe. In another embodiment, the heel location mark is U-shaped to correspond to a general outline shape of the heel of a foot. In still another embodiment, the heel location mark is an end line.

In another embodiment, the outsole also has a second reference mark distal from the first reference mark corresponding to a clearance distance within the shoe. In still another alternative embodiment, the second reference mark indicates a fit too small for the foot. In yet another embodiment, the outsole also contains a third reference mark intermediate to the heel location mark and the first reference mark corresponding to a fit too big for the foot.

In yet another embodiment, the outsole comprises a fourth reference mark corresponding to width within the shoe. In another embodiment, the outsole comprises a fifth reference mark corresponding to where the ball of the foot should align when the heel is placed in the heel location mark. In yet still another embodiment, the outsole further comprises an outline corresponding to the overall shape within the shoe.

In still another alternative embodiment the reference gauge of the outsole is an outline which corresponds with a perimeter outlining the interior space from heel to toe available within the shoe for proper fit.

In another embodiment the reference gauge of the alternative configuration is substantially shaped like a foot.

In another embodiment, the outsole has a reference mark at the distal end corresponding to a clearance distance from the end of the toes to the interior end of the shoe. In another embodiment this reference mark indicates a fit too small.

In another embodiment, the outsole has another reference mark at the proximal end corresponding to a persons heel inside the shoe.

In another embodiment, the outsole has another reference mark intermediate to the clearance distance reference mark and heel reference mark corresponding to proper fit.

In another embodiment of the alternative configuration the outsole has another reference mark intermediate to the proper fit reference mark and heel reference mark corresponding to a fit too big.

In yet another embodiment, the outsole has a reference mark corresponding to a width within the shoe.

In yet another embodiment, the invention is a method for determining fit of a shoe from outside the shoe including the preferred steps of providing a shoe with the various embodiments described above placing the heel of a foot at the heel reference mark and further placing the foot on the exterior of the outsole so the heel remains on the heel location mark and the toes extend along the outsole toward the distal end of the outsole and comparing the extension of the toes to each respective reference mark on the outsole to determine and ensure a proper fit of the shoe on the foot.

All of these embodiments described herein, including the method of determining the proper fit of a shoe will allow consumers to serve themselves without reliance on a shoe size gauge. These shoe size gauges may be available in some stores for consumers to use, but in most cases, they are not. Even when available, they are often difficult to use due to the complexity of reference marks indicating both width and size for each foot. When read properly they are accurate but only for manufacturers and brands that strictly follow the size standards for that particular measuring devise as there is no common industry standard for fit and size marking. International and gender size conversions further confuse and complicate the size selection process even for professional shoe fitters. Therefore, the present invention provides a useful and simple means for checking proper shoe size especially for consumers who have to fit themselves.

BRIEF DESCRIPTION OF THE DRAWINGS

For a fuller understanding of the nature and objects of the invention, reference should be made to the following detailed description, taken in connection with the accompanying drawings, in which.

Figure 1:
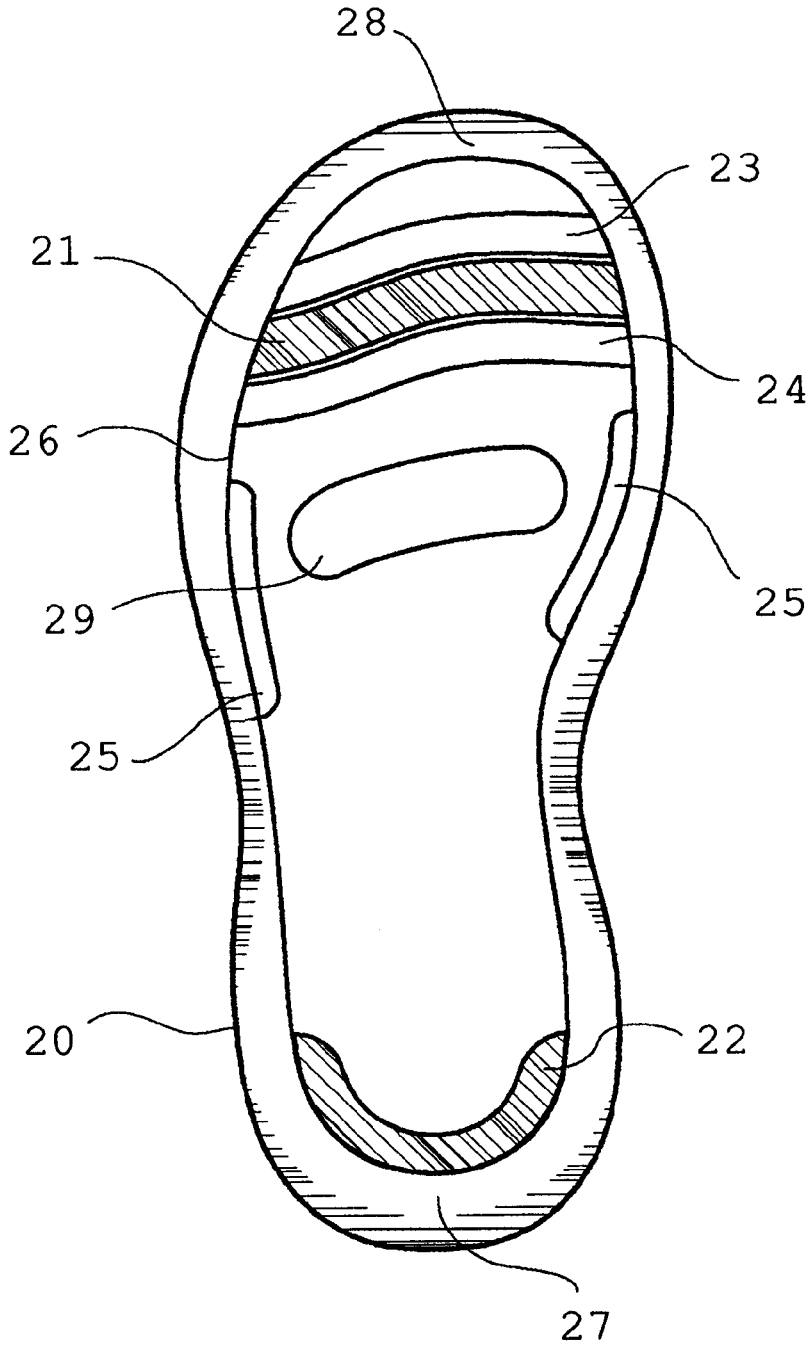
FIG. 1 is a perspective view of the present invention preferred embodiment.

These drawings are merely examples and are not intended to limit the invention in any way.

DETAILED DESCRIPTION OF THE INVENTION

Referring now to the drawings, FIGS. 1–5, the invention which is a shoe enabling determination of fit from outside the shoe, is depicted generally as 10. The shoe 10, used to protect a foot 30, may be made of any of the materials known in the art, including leather, rubber, plastic and fabric. The outside of the shoe 10 comprises an outsole 20 or bottom, which may include a transparent layered bottom surface through which the reference marks described below can be observed when looking at the outsole, or an opaque bottom surface on which the marks described below are included. The outsole 20 also can be made of many materials known in the art, including leather, rubber, plastic, fabric and wood.

Figure 3:
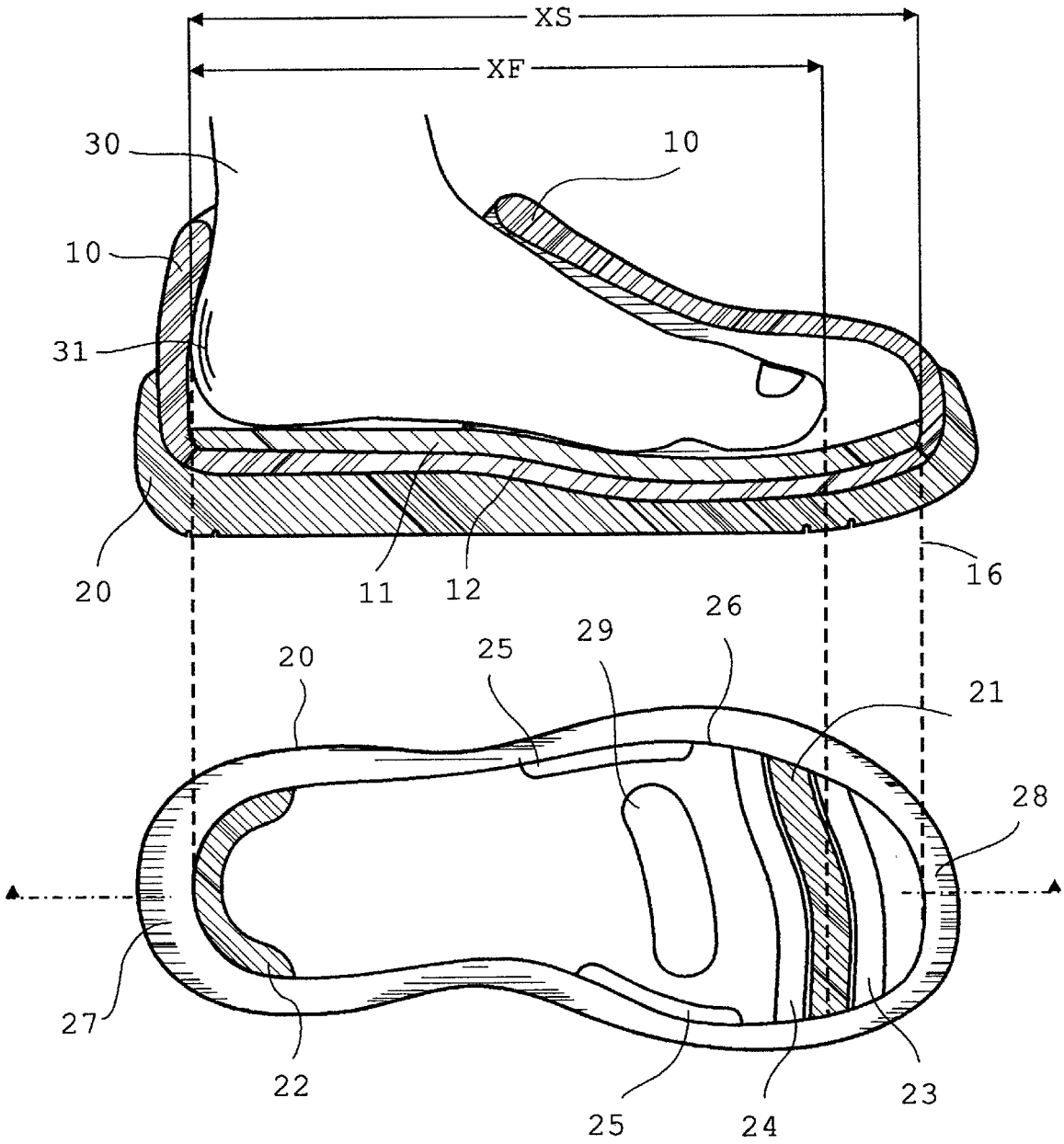
FIG. 3 is a projected side cross-sectional view in relation to a perspective view the present invention.
Figure 4:
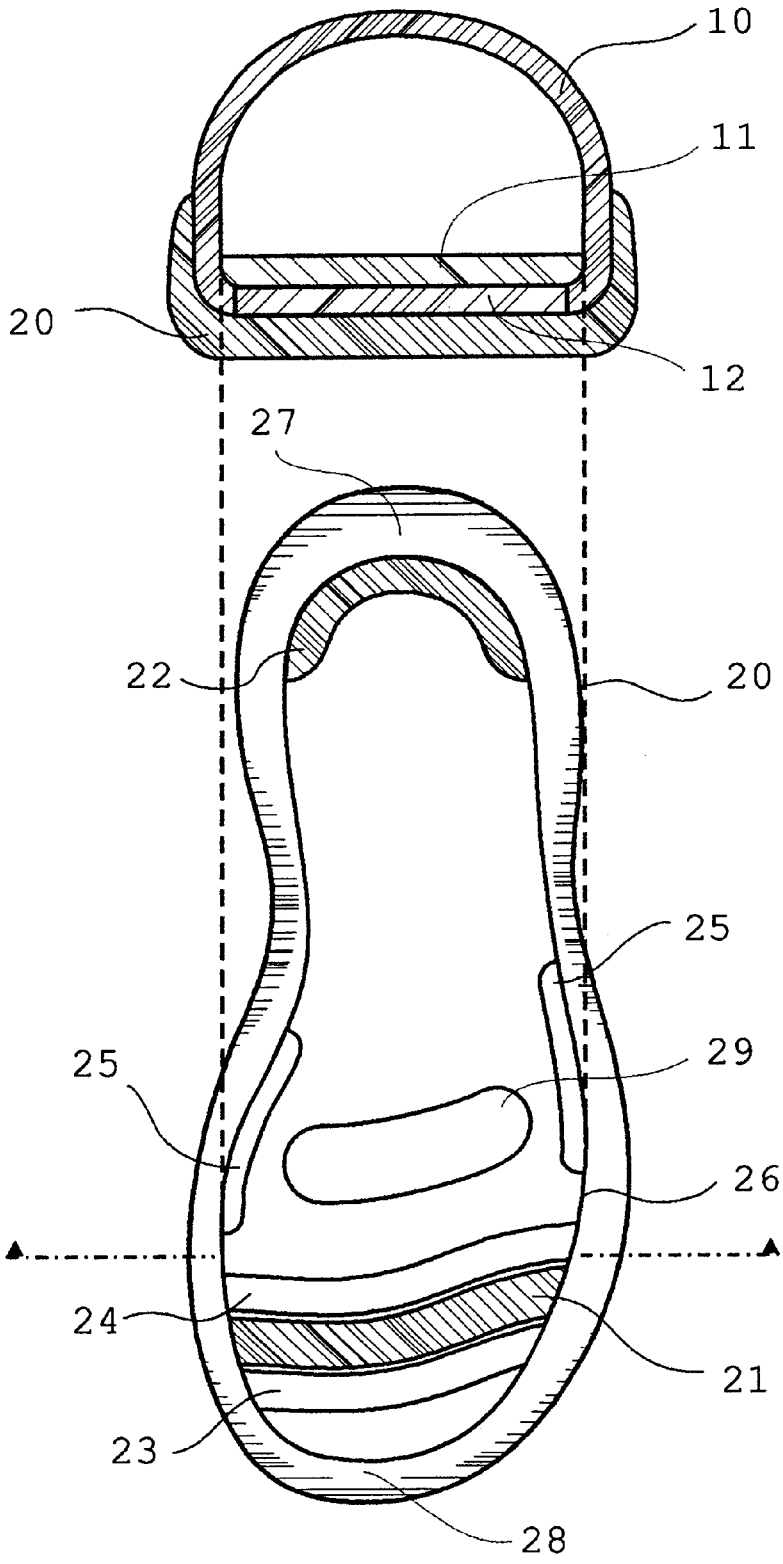
FIG. 4 is a projected cross-sectional view in relation to a perspective view of the present invention.
Figure 5:
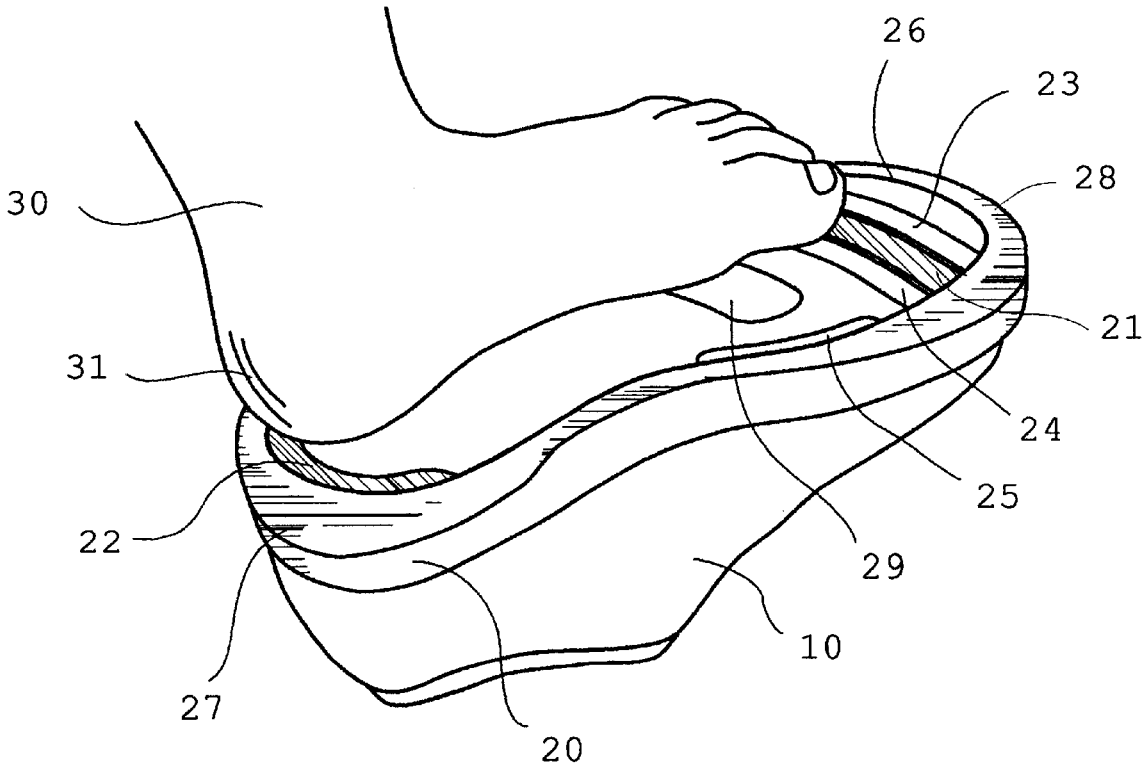
FIG. 5 is a perspective view of the invention in use.

For reference purposes when reading the disclosure hereinafter and when referring to the drawings, the shoe sock-lining is designated as 11, the insole is designated as 12, and the tip of the inside space of the shoe is designated as 16. The outsole 20 of the shoe 10 includes a heel location mark 22 at the proximal end 27 of the outsole 20 for the placing of the heel 31 of the foot 30 as generally shown in FIG. 5. The heel location mark is shaped to correspond with a person's heel 31. The heel location mark 22 may comprise of one or more marks and may be substantially U-shaped or substantially an end line or comprise of a pattern, design, another shape or other shapes. The preferred embodiment is a substantially U-shaped heel location mark, as shown in FIGS. 1, 3 and 4. The heel location mark 22 may be permanently or temporarily affixed to the outsole 20. The heel location mark 20 (as well as the other reference marks described herein and chosen to be included in the invention 10) may be placed on the outsole 20 by being molded into, painted, printed, inscribed into the outsole 20 or even covered by a clear outsole layer, as long as the reference marks are visible when looking at the outsole 20. Other means of placing the heel location mark 22 on the outsole 20 are known in the art. In an alternative embodiment, the heel location gauge 22 corresponds with a heel 31 placement inside the shoe 10.

In addition, the outsole 20 comprises a first reference mark 21 at the distal end 28 of the outsole 20, corresponding to where the toes of the foot 30 should extend when the heel 31 is placed on the heel location mark 22. Together the heel location mark 22 and first reference mark 21 define an internal heel to toe length fit, as represented in FIG. 3 by line "XF", of the shoe 10 relative to ensuring proper fit on the foot 30. Reference mark 21 may be a bar, a line, a series of lines, pattern, design, symbols or an area indicating a range within which the toes of the foot 30 may extend from the heel location mark 22 so that the shoe 10 would still fit. Additional means for providing a first reference mark 21 corresponding to where the toes should align for proper fit are also known in the art.

Alternately, the outsole 20 may further comprise a second reference mark 23. The second reference mark corresponds with the room left within the shoe 10 from the distal end of the first reference mark 21. The second reference mark 23 thus may operate as a warning bar reference which indicates the maximum recommended allowance for toe room and growth. The second reference mark may alternatively measure a clearance distance for the foot 30 distally up to the tip 16 of the inside of the shoe 10, or vamp. However, the measured clearance distance may also be to the end of the sole part inside the shoe 10, or any other point between the tip 16 and first reference mark 21. The overall heel to inside tip 16 distance is depicted as distance "XS" on FIG. 3. A comparison of the foot against the outsole 20 and its reference mark 23 will assist the customer in determining if the shoe is too small.

Alternatively, the outsole 20 may comprise a third reference mark 24 intermediate to the heel location mark 22 and reference mark 21. Reference mark 24 indicates a fit too big when end of toes of foot 30 fall in this area when the heel 31 is aligned with heel location mark 22. The outsole 20 may also comprise reference mark 25 corresponding with the width of the inside of the shoe 10. FIGS. 1, 3, 4 and 5 show reference mark 25 as intermediate between heel location mark 22 and reference mark 24. However, other configurations for the fourth reference mark 25 are also contemplated. Furthermore, FIGS. 1, 3, 4 and 5 show width reference mark 25 as two marks. However, the width reference mark 25 may also be indicated by a single area, outline or other means for describing the width within the shoe on the outsole 20.

The outsole 20 may also comprise a fifth reference mark 29 intermediate to the heel location mark 22 and third reference mark 24. Reference mark 29 corresponds to where the ball of the foot 30 should align when the heel 31 is in the heel location mark 22 to ensure a proper measurement of the toes against the first reference mark 21, which corresponds to an indication of "proper fit." Reference mark 29 may be an outline, line or area indicating the proper placement for the ball of the foot. The fifth reference mark 29 may also be molded into, painted, printed or inscribed into the outsole 20.

As another embodiment, the outsole 20 may also comprise an outline 26 corresponding with the overall shape within the shoe 10. The outline 26 may also be molded into, painted, printed or inscribed into the outsole 20. The outline 26 may be permanently or temporarily placed on the outsole 20.

The current invention contemplates that the heel location mark 22, first reference mark 21, second reference mark 23, third reference mark 24, fourth reference mark 25, fifth reference mark 29 and the outline 26 may be placed on the outsole 20 in any combination such that it is observable by looking at the bottom of the shoe. Furthermore the means for placing the applicable heel location mark 22, first reference mark 21, second reference mark 23, third reference mark 24, fourth reference mark 25, fifth reference mark 29 or outline 26, permanently or temporarily, may be different from one another or the same.

Figure 2:
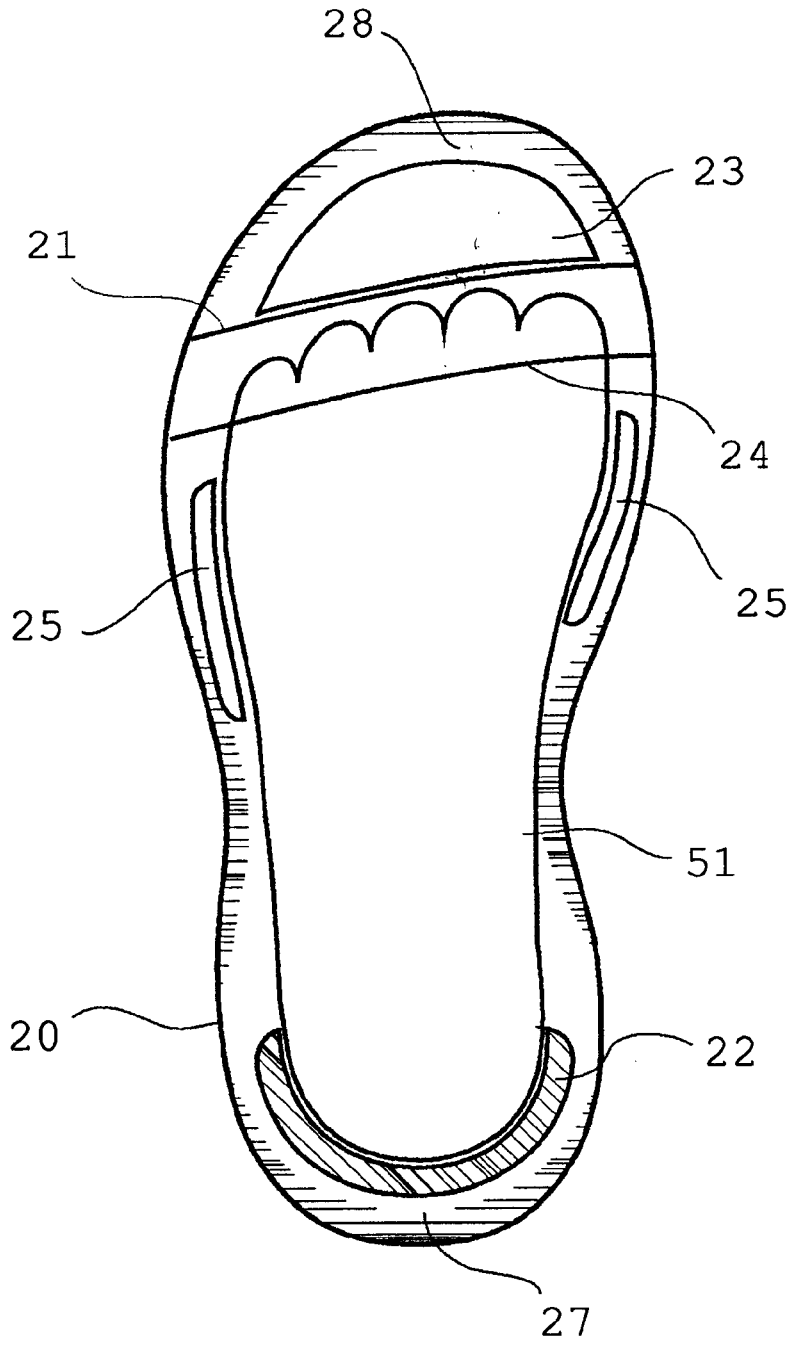
FIG. 2 is a perspective view of the present invention alternative embodiment.

In an alternative configuration of the reference gauge shown in FIG. 2, an outline 51 corresponds to the interior space available within the shoe 10 to ensure proper fit of the foot 30. The outline 51 may be substantially shaped like a foot or an area indicating placement of a foot 30 to determine proper fit when foot 30 is placed against the heel reference gauge. The reference gauge of outline 51 may be a series of lines, pattern, design, color or texture to offset it visually on the outsole 20 bottom. The alternative configuration of the reference gauge, as shown in FIG. 2, may also incorporate elements of the preferred embodiment, heel location mark 22, first reference mark 21, second reference mark 23, third reference mark 24, fourth reference mark 25 and fifth reference mark 29. The reference gauge outline 51, may be molded into, painted, printed or inscribed into the outsole 20. The reference gauge outline 51 may be permanently or temporarily placed on the outsole 20.

The current invention contemplates that the reference gauge outline 51, heel location mark 22, first reference mark 21, second reference mark 23, third reference mark 24 and fourth reference mark 25 may be placed on the outsole 20 in any combination. Furthermore the means for placing the applicable reference gauge outline 51, heel location mark 22, first reference mark 21, second reference mark 23, third reference mark 24 or fourth reference mark 25, permanently or temporarily, may be different from one another or the same.

To provide an example of the preferred embodiment of the invention as used, a person seeks to buy a shoe 10 incorporating the present invention. The person places a foot 30 on the outsole 20 of the shoe, aligning the heel 31 with the heel location mark 22 (or at the heel portion of the reference gauge 51 as the case may be). If the outsole 20 is so equipped, the person may place the ball of the foot 30 where indicated on the outsole 20 by the fifth reference mark 29. After the persons foot 30 is properly aligned, the person may quickly determine whether that person's toes extend to an area described by the first reference mark 21 indicating proper fit. If the toes extend beyond the first reference mark 21 to an area described by the second reference mark 23, the shoe 10 will be too small. Similarly, if the person's toes fall short of the first reference mark 21, into the area described by reference mark 24 the shoe 10 will be too large. An example of using the alternative embodiment, a person places a foot 30 on the outsole 20 of the shoe 10, aligning it within the reference gauge outline 51. After that person's foot 30 is properly aligned, the person may easily determine whether the foot fits inside, is bigger or smaller than the reference gauge outline 51. If so equipped heel location mark 22, first reference mark 21, second reference mark 23, third reference mark 24 and fourth reference mark 25 would further assist in determining proper fit.

As seen from the foregoing description, the present invention satisfies a long felt need to provide a device which is easy to use. The invention is especially convenient for people that want to purchase shoes without trying them on, and for people buying shoes for children. In addition, the invention is especially helpful in self-service locations or locations with insufficient sales stall to help a person choose the correct size. In addition, the invention will be especially useful for a person seeking to buy a shoe for a child where the child's shoe size is not known, and where the person seeks to monitor a child's growth as related to the child's shoe size.

The invention is clearly new and useful. Moreover, it was not obvious to those of ordinary skill in this art at the time it was made, in view of the prior art as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrations and not in the limiting sense.

It is also to be understood that the following claims are intended to cover all of the generic and specific features of the invention herein described, and all statements of the scope of the invention which, as a matter of language, might be said to fall there between.

Now that the invention has been described,

What is claimed is:

1. A shoe comprising:

an outsole, the outsole being such that the interior space of the shoe is not observable by looking at the outsole from its bottom surface; and the outsole having a reference gauge, the reference gauge defining an interior space corresponding to a heel to toe length fit within the shoe, wherein the reference gauge is observable by looking at the outsole from its bottom surface, and wherein the bottom surface of the outsole can be placed against a bottom of a foot and the reference gauge is used to determine proper fit of the shoe on the foot.

2. The shoe according to claim 1, wherein the reference gauge includes:

a heel location mark at a proximal end of the outsole for placing a heel of a foot, the heel location mark defining an extremity reference location for placing a back end of the heel and corresponding to a location of the back end of the person's heel when inside the shoe; and a toe extension reference mark at the distal end of the outsole, the toe extension reference mark defining an area corresponding to where toes of the foot should extend when heel is placed on the heel location mark.

3. The shoe according to claim 2, wherein the heel location mark is substantially U-shaped to correspond to the heel of a foot.

4. The shoe according to claim 2, wherein the heel location mark is an end line.

5. The shoe according to claim 2, wherein the outsole further comprises:

a toe clearance reference mark distal from the toe extension reference mark, the toe clearance reference mark corresponding to a clearance distance for the toes within the shoe.

6. The shoe according to claim 2, wherein the outsole further comprises:

a shoe too big reference mark intermediate to the heel location mark and toe extension reference mark, the shoe too big reference mark corresponding to a fit too big.

7. The shoe according to claim 6, wherein the outsole further comprises:

a reference mark intermediate to the shoe too big reference mark and heel location mark corresponding to where the ball of the foot should align when the heel is placed in the heel location mark.

8. The shoe according to claim 2, wherein the outsole further comprises:

a width reference mark corresponding to a width within the shoe.

9. The shoe according to claim 2, wherein the outsole further comprises:

an outline corresponding with an overall shape within the shoe.

10. The shoe according to claim 1, wherein the reference gauge is an outline corresponding to an interior space available within the shoe to ensure proper fit.

11. The shoe according to claim 10, wherein the reference gauge is substantially shaped like a foot.

12. The shoe according to claim 10, wherein the outsole further comprises:

a toe clearance reference mark at the distal end of the outsole corresponding to a clearance distance within the shoe.

13. The shoe according to claim 10, wherein the outsole further comprises:

a heel reference mark at the proximal end of the outsole corresponding to a person's heel inside the shoe.

14. The shoe according to claim 10, wherein the outsole further comprises:

a proper fit reference mark intermediate to the toe clearance reference mark and the heel reference mark, the proper fit reference mark corresponding to a proper fit.

15. The shoe according to claim 14, wherein the outsole further comprises:

a shoe too big reference mark intermediate to the proper fit reference mark and heel reference mark, the shoe too big reference mark corresponding to a fit too big.

16. The shoe according to claim 10, wherein the outsole further comprises:

a width reference mark corresponding to a width within the shoe.

17. A system for determining the fit of a shoe having an opaque outsole comprising:

a reference gauge defining an interior space corresponding to a heel to toe length fit within the shoe, wherein the reference gauge is observable by looking at the outsole from its bottom surface, and wherein the bottom surface of the outsole can be placed against a bottom of a foot and the reference gauge is used to determine proper fit of the shoe on the foot.

18. The system according to claim 17, wherein the reference gauge includes:

a heel location mark at a proximal end of the outsole for placing a heel of a foot, the heel location mark defining an extremity reference location for placing a back end of the heel and corresponding to a location of the back end of the person's heel when inside the shoe; and a toe extension reference mark at the distal end of the outsole, the toe extension reference mark defining an area corresponding to where toes of the foot should extend when heel is placed on the heel location mark.

19. The system according to claim 18, wherein the heel location mark is substantially U-shaped to correspond to the heel of a foot.

20. The system according to claim 18, wherein the heel location mark is an end line.

21. The system according to claim 18, wherein the outsole further comprises:

a toe clearance reference mark distal from the toe extension reference mark, the toe clearance reference mark corresponding to a clearance distance for the toes within the shoe.

22. The system according to claim 18, wherein the outsole further comprises:

a shoe too big reference mark intermediate to the heel location mark and toe extension reference mark, the shoe too big reference mark corresponding to a fit too big.

23. The system according to claim 18, wherein the outsole further comprises:

a width reference mark corresponding to a width within the shoe.

24. The system according to claim 18, wherein the outsole further comprises:

a reference mark intermediate to the shoe too big reference mark and heel location mark corresponding to where the ball of the foot should align when the heel is placed in the heel location mark.

25. The system according to claim 18, wherein the outsole further comprises:

an outline corresponding with an overall shape within the shoe.

26. The system according to claim 17, wherein the reference gauge is an outline corresponding to an interior space available within the shoe to ensure proper fit.

27. The system according to claim 26, wherein the reference gauge is substantially shaped like a foot.

28. The system according to claim 26, wherein the outsole further comprises:

a toe clearance reference mark at the distal end of the outsole corresponding to a clearance distance within the shoe.

29. The system according to claim 26, wherein the outsole further comprises:

a heel reference mark at the proximal end of the outsole corresponding to a person's heel inside the shoe.

30. The system according to claim 26, wherein the outsole further comprises:

a proper fit reference mark intermediate to the toe clearance reference mark and the heel reference mark, the proper fit reference mark corresponding to a proper fit.

31. The system according to claim 26, wherein the outsole further comprises:

a shoe too big reference mark intermediate to the proper fit reference mark and heel reference mark, the shoe too big reference mark corresponding to a fit too big.

32. The system according to claim 26, wherein the outsole further comprises:

a width reference mark corresponding to a width within the shoe.

33. A shoe comprising:

an outsole, the outsole being such that the interior space of the shoe is not observable by looking at the outsole from its bottom surface;

the outsole having a heel location mark at a proximal end of the outsole, the heel location mark defining an extremity reference location for placing a back end of a heel of a foot, the heel location mark further corresponding to a location of the back end of a person's heel when inside the shoe; and a toe extension reference mark at a distal end of the outsole, the toe extension reference mark corresponding to where toes of the foot should extend when the back end of the heel is placed on the heel location mark, wherein the heel location mark, and the toe extension reference mark are observable by looking at the outsole from its bottom surface, and wherein when the bottom surface of the outsole is placed against a bottom of the foot, the heel location mark, and the toe extension reference mark are used to determine the proper fit of the shoe on the foot.

34. The shoe according to claim 33, further comprising:

a toe clearance reference mark distal from the toe extension reference mark, the toe clearance reference mark corresponding to a toe clearance distance within the shoe.

35. The shoe according to claim 34, wherein the outsole further comprises:

a shoe too big reference mark intermediate to the heel location mark and toe extension reference mark, the shoe too big reference mark corresponding to a fit too big.

36. The shoe according to claim 35, wherein the outsole further comprises:

a reference mark intermediate to the shoe too big reference mark and heel location mark corresponding to where the ball of the foot should align when the heel is placed in the heel location mark.

37. The shoe according to claim 34, wherein the outsole further comprises:

a proper fit reference mark intermediate to the toe clearance reference mark and the heel location mark, the proper fit reference mark corresponding to a proper fit.

38. The shoe according to claim 33, wherein the heel location mark is substantially U-shaped to correspond to the heel of the foot.

39. The shoe according to claim 33, wherein the heel location mark is an end line.

40. The shoe according to claim 33, wherein the outsole further comprises:

a width reference mark corresponding to a width within the shoe.

41. The shoe according to claim 33, wherein the outsole further comprises:

an outline corresponding with an overall shape within the shoe.

42. The shoe according to claim 33, wherein the outsole further comprises:

a shoe too big reference mark intermediate to the proper fit reference mark and heel location mark, the shoe too big reference mark corresponding to a fit too big.

43. The shoe according to claim 33, herein the outsole further comprises:

a width reference mark corresponding to a width within the shoe.

44. A system for determining the fit of a shoe having an opaque outsole comprising:

the outsole having a heel location mark at a proximal end of the outsole, the heel location mark defining an extremity reference location for placing a back end of a heel of a foot, the heel location mark further corresponding to a location of the back end of a person's heel when inside the shoe; and a toe extension reference mark at a distal end of the outsole, the toe extension reference mark corresponding to where toes of the foot should extend when the back end of the heel is placed on the heel location mark, wherein the heel location mark, and the toe extension reference mark are observable by looking at the outsole from its bottom surface, and wherein when the bottom surface of the outsole is placed against a bottom of the foot, the heel location mark, and the toe extension reference mark are used to determine the proper fit of the shoe on the foot.

45. The system according to claim 44, further comprising:

a toe clearance reference mark distal from the toe extension reference mark, the toe clearance reference mark corresponding to a toe clearance distance within the shoe.

46. The system according to claim 45, wherein the outsole further comprises:

a shoe too big reference mark intermediate to the heel location mark and toe extension reference mark, the shoe too big reference mark corresponding to a fit too big.

47. The system according to claim 46, wherein the outsole further comprises:

a reference mark intermediate to the shoe too big reference mark and heel location mark corresponding to where the ball of the foot should align when the heel is placed in the heel location mark.

48. The system according to claim 45, wherein the outsole further comprises:

a proper fit reference mark intermediate to the toe clearance reference mark and the heel location mark, the proper fit reference mark corresponding to a proper fit.

49. The system according to claim 44, wherein the heel location mark is substantially U-shaped to correspond to the heel of the foot.

50. The system according to claim 44, wherein the heel location mark is an end line.

51. The system according to claim 44, wherein the outsole further comprises:

a width reference mark corresponding to a width within the shoe.

52. The system according to claim 44, wherein the outsole further comprises:

an outline corresponding with an overall shape within the shoe.

53. The system according to claim 44, wherein the outsole further comprises:

a shoe too big reference mark intermediate to the proper fit reference mark and heel location mark, the shoe too big reference mark a fit too big.

54. The system according to claim 53, the outsole further comprises:

a width reference mark corresponding to a width within the shoe.

55. A method for determining the fit of a shoe from outside the shoe comprising:

providing a shoe having an outsole such that the interior space of the shoe is non-observable by looking at the outsole from its bottom surface, including a reference gauge defining an interior space within the shoe relative to fit, wherein the reference gauge is observable by looking at the outsole from its bottom surface;

placing the bottom of the foot on the bottom surface of the outsole and aligning the bottom of the foot with the reference gauge; and comparing the bottom of the foot with the reference gauge for enabling the determination of the proper fit of the shoe on the foot.

56. The method according to claim 55, wherein the reference gauge includes:

a heel location mark at a proximal end of the outsole for placing a heel of a foot, the heel location mark defining an extremity reference location for placing a back end of the heel and corresponding to a location of the back end of the person's heel when inside the shoe; and a toe extension reference mark at the distal end of the outsole, the toe extension reference mark defining an area corresponding to where toes of the foot should extend when heel is placed on the heel location mark.

57. The method according to claim 56, wherein the heel location mark is substantially U-shaped to correspond to the heel of a foot.

58. The method according to claim 56, wherein the heel location mark is an end line.

59. The method according to claim 56, wherein the outsole further comprises:

a toe clearance reference mark distal from the toe extension reference mark, the toe clearance reference mark corresponding to a clearance distance for the toes within the shoe, wherein a determination of toe clearance can further be made when placing the outsole against the bottom of the foot.

60. The method according to claim 56, wherein the outsole further comprises:

a shoe too big reference mark intermediate to the heel location mark and toe extension reference mark, the shoe too big reference mark corresponding to a fit too big, wherein a determination can be made if the shoe is too big when placing the shoe outsole against the bottom of the foot.

61. The method according to claim 60, wherein the outsole further comprises:

a reference mark intermediate to the shoe too big reference mark and heel location mark corresponding to where the ball of the foot should align when the heel is placed in the heel location mark.

62. The method according to claim 56, wherein the outsole further comprises:

a width reference mark corresponding to a width within the shoe, wherein a determination can be made if the width of the shoe is proper when placing the outsole against the bottom of the foot.

63. The method according to claim 56, wherein the outsole further comprises:

an outline corresponding with an overall shape within the shoe.

64. The method according to claim 55, wherein the reference gauge is an outline corresponding to an interior space available within the shoe to ensure proper fit.

65. The method according to claim 64, wherein the outsole further comprises:

a width reference mark corresponding to a width within the shoe, wherein a determination can be made if the width of the shoe is proper when placing the outsole against the bottom of the foot.

66. The method according to claim 64, wherein the reference gauge is substantially shaped like a foot.

67. The method according to claim 64, wherein the outsole further comprises:

a toe clearance reference mark at the distal end of the outsole corresponding to a clearance distance within the shoe, wherein a determination of toe clearance can further be made when placing the outsole against the bottom of the foot.

68. The method according to claim 64, wherein the outsole further comprises:

a heel reference mark at the proximal end of the outsole corresponding to a person's heel inside the shoe.

69. The method according to claim 64, wherein the outsole further comprises:

a proper fit reference mark intermediate to the toe clearance reference mark and the heel reference mark, the proper fit reference mark corresponding to a proper fit.

70. The method according to claim 69, wherein the outsole further comprises:

a shoe too big reference mark intermediate to the proper fit reference mark and heel reference mark, the shoe too big reference mark corresponding to a fit too big, wherein a determination can be made if the shoe is too big when placing the shoe outsole against the bottom of the foot.

71. A method for determining the fit of a shoe from outside the shoe comprising:

providing a shoe having an outsole such that the interior space of the shoe is non-observable by looking at the outsole from its bottom surface, including a heel location mark at a proximal end of the outsole, the heel location mark defining an extremity reference location for placing a back end of a heel of a foot, the heel location mark further corresponding to a location of the back end of a person's heel when inside the shoe;

providing a toe extension reference mark at a distal end of the outsole, the toe extension reference mark corresponding to where toes of the foot should extend when the back end of the heel is placed on the heel location mark, wherein the heel location mark and the toe extension reference mark are observable by looking at the outsole from its bottom surface;

placing the back end of the heel on the heel location mark located on the proximal end of the outsole of the shoe;

placing the foot on the outsole so the back end of the heel remains on the heel location mark and the toes extend along the outsole toward the distal end of the outsole; and comparing the extension of the toes to the toe extension reference mark on the distal end of the outsole corresponding to where the toes of the foot should extend when the back end of the heel is placed on the heel location mark for enabling the determination of the proper fit of the shoe on the foot.

72. The method according to claim 71, further comprising:

a toe clearance reference mark distal from the toe extension reference mark, the toe clearance reference mark corresponding to a toe clearance distance within the shoe, wherein a determination of toe clearance can further be made when placing the outsole against the bottom of the foot.

73. The method according to claim 72, wherein the outsole further comprises:

a shoe too big reference mark intermediate to the heel location mark and toe extension reference mark, the shoe too big reference mark corresponding to a fit too big, wherein a determination can be made if the shoe is too big when placing the shoe against the bottom of the foot.

74. The method according to claim 73, wherein the outsole further comprises:

a reference mark intermediate to the shoe too big reference mark and heel location mark corresponding to where the ball of the foot should align when the heel is placed in the heel location mark.

75. The method according to claim 72, wherein the outsole further comprises:

a proper fit reference mark intermediate to the toe clearance reference mark and the heel location mark, the proper fit reference mark corresponding to a proper fit.

76. The method according to claim 71, wherein the heel location mark is substantially U-shaped to correspond to the heel of the foot.

77. The method according to claim 71, wherein the heel location mark is an end line.

78. The method according to claim 71, wherein the outsole further comprises:

a width reference mark corresponding to a width within the shoe, wherein a determination can be made if the width of the shoe is proper when placing the outsole against the bottom of the foot.

79. The method according to claim 71, wherein the outsole further comprises:

an outline corresponding with an overall shape within the shoe.

80. The method according to claim 71, wherein the outsole further comprises:

a shoe too big reference mark intermediate to the proper fit reference mark and heel location mark, the shoe too big reference mark corresponding to a fit too big, wherein a determination can be made if the shoe is too big when placing the shoe outsole against the bottom of the foot.

81. The method according to claim 80, wherein the outsole further comprises:

a width reference mark corresponding to a width within the shoe, wherein a determination can be made if the width of the shoe is proper when placing the outsole against the bottom of the foot.

* * * * *